US007738629B2

(12) United States Patent
Chen

(10) Patent No.: US 7,738,629 B2
(45) Date of Patent: Jun. 15, 2010

(54) X-RAY FOCUSING OPTIC HAVING MULTIPLE LAYERS WITH RESPECTIVE CRYSTAL ORIENTATIONS

(75) Inventor: Zewu Chen, Schenectady, NY (US)

(73) Assignee: X-Ray Optical Systems, Inc., East Greenbush, NY (US)

( * ) Notice: Subject to any disclaimer, the term of this patent is extended or adjusted under 35 U.S.C. 154(b) by 0 days.

(21) Appl. No.: 11/941,377

(22) Filed: Nov. 16, 2007

(65) Prior Publication Data

US 2008/0117511 A1 May 22, 2008

Related U.S. Application Data

(60) Provisional application No. 60/866,134, filed on Nov. 16, 2006.

(51) Int. Cl.
*G21K 1/06* (2006.01)

(52) U.S. Cl. ..... 378/84

(58) Field of Classification Search ..... 378/84, 378/85, 145

See application file for complete search history.

(56) References Cited

U.S. PATENT DOCUMENTS 4,261,771 A 4/1981 Dingle et al.
5,127,028 A * 6/1992 Wittry ..... 378/84
5,757,883 A * 5/1998 Haisma et al. ..... 378/84
6,498,830 B2 * 12/2002 Wittry ..... 378/84

FOREIGN PATENT DOCUMENTS

JP 04204297 7/1992

OTHER PUBLICATIONS

International Search Report for corresponding PCT application No. US2007/084938 dated Jul. 17, 2008.

Celler et al., "Frontiers of Silicon-on-insulator", Journal of Applied Physics, vol. 93, No. 9, May 1, 2003, pp. 4955-4976.

* cited by examiner

*Primary Examiner*—Jurie Yun

(74) *Attorney, Agent, or Firm*—Jeffrey Klembczyk, Esq.; Kevin P. Radigan, Esq.; Heslin Rothenberg Farley & Mesiti P.C.

(57) ABSTRACT

A diffracting x-ray optic for accepting and redirecting x-rays. The optic includes at least two layers, the layers having a similar or differing material composition and similar or differing crystalline orientation. Each of the layers exhibits a diffractive effect, and their collective effect provides a diffractive effect on the received x-rays. In one embodiment, the layers are silicon, and are bonded together using a silicon-on-insulator bonding technique. In another embodiment, an adhesive bonding technique may be used. The optic may be a curved, monochromating optic.

26 Claims, 7 Drawing Sheets

X-RAY FOCUSING OPTIC HAVING MULTIPLE LAYERS WITH RESPECTIVE CRYSTAL ORIENTATIONS

CROSS-REFERENCE TO RELATED APPLICATIONS

This application claims the benefit of U.S. Provisional Application No. 60/866,134, filed Nov. 16, 2006. This Provisional Application is hereby incorporated herein by reference in its entirety.

TECHNICAL FIELD

This invention relates in general to x-ray optics, and in particular to an improved x-ray focusing crystal optic having multiple layers, each layer having a predetermined crystalline orientation.

BACKGROUND OF THE INVENTION

In x-ray analysis systems, high x-ray beam intensity and small beam spot sizes are important to reduce sample exposure times, increase spatial resolution, and consequently, improve the signal-to-background ratio and overall quality of x-ray analysis measurements. In the past, expensive and powerful x-ray sources, such as rotating anode x-ray tubes or synchrotrons, were the only options available to produce high-intensity x-ray beams. Recently, the development of x-ray optic devices has made it possible to collect the diverging radiation from an x-ray source by focusing the x-rays. A combination of x-ray focusing optics and small, low-power x-ray sources can produce x-ray beams with intensities comparable to those achieved with more expensive devices. As a result, systems based on a combination of small, inexpensive x-ray sources, excitation optics, and collection optics have greatly expanded the availability and capabilities of x-ray analysis equipment in, for example, small laboratories and in the field.

Monochromatization of x-ray beams in the excitation and/or detection paths is also useful, as discussed above. One existing x-ray monochromatization technology is based on diffraction of x-rays on optical crystals, for example, germanium (Ge) or silicon (Si) crystals. Curved crystals can provide deflection of diverging radiation from an x-ray source onto a target, as well as providing monochromatization of photons reaching the target. Two common types of curved crystals are known as singly-curved crystals and doubly-curved crystals (DCCs). Using what is known in the art as Rowland circle geometry, singly-curved crystals provide focusing in two dimensions, leaving x-ray radiation unfocused in the third or orthogonal plane. Doubly-curved crystals provide focusing of x-rays from the source to a point target in all three dimensions. This three-dimensional focusing is referred to in the art as "point-to-point" focusing.

Commonly-assigned U.S. Pat. Nos. 6,285,506 and 7,035,374 disclose various configurations of curved x-ray optics for x-ray focusing and monochromatization. In general, these patents disclose a flexible layer of material (e.g., Si) formed into curved optic elements. The monochromating function, and the transmission efficiency of the optic are determined by the crystal structure of the optic. The present invention provides certain improvements in the formation of curved crystal optics, offering important performance advantages.

SUMMARY OF THE INVENTION

The shortcomings of the prior art are overcome and additional advantages are provided by the present invention, which in one aspect is an optic for accepting and redirecting x-rays, the optic having at least two layers, the layers having a similar or differing material composition and similar or differing crystalline orientation. Each of the layers exhibits a diffractive effect, and their collective effect provides a diffractive effect on the received x-rays. In one embodiment, the layers are silicon, and are bonded together using a silicon-on-insulator bonding technique. In another embodiment, an adhesive bonding technique may be used. The optic may be a curved, monochromating optic.

In another aspect, the present invention is a method for forming an x-ray optic, using a material-on-insulator bonding technique to bond at least two material layers together, each of the at least two layers having a pre-determined crystalline orientation. In one embodiment, the two layers may be formed into a curved, monochromating optic.

Further additional features and advantages are realized through the techniques of the present invention. Other embodiments and aspects of the invention are described in detail herein and are considered a part of the claimed invention.

BRIEF DESCRIPTION OF THE DRAWINGS

The subject matter regarded as the invention is particularly pointed out and distinctly claimed in the claims at the conclusion of the specification. The foregoing and other objects, features, and advantages of the invention are apparent from the following detailed description taken in connection with the accompanying drawings in which:

DESCRIPTION OF THE INVENTION

Figure 1A:
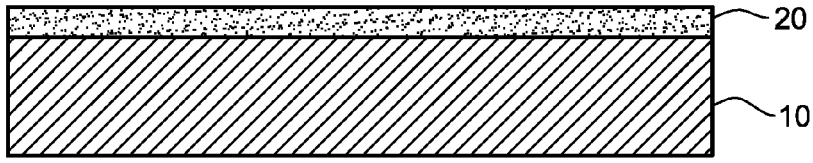
FIGS. 1*a-i* depict the formation of a layered optic structure in respective processing steps, in accordance with an aspect of the present invention.
Figure 1B:
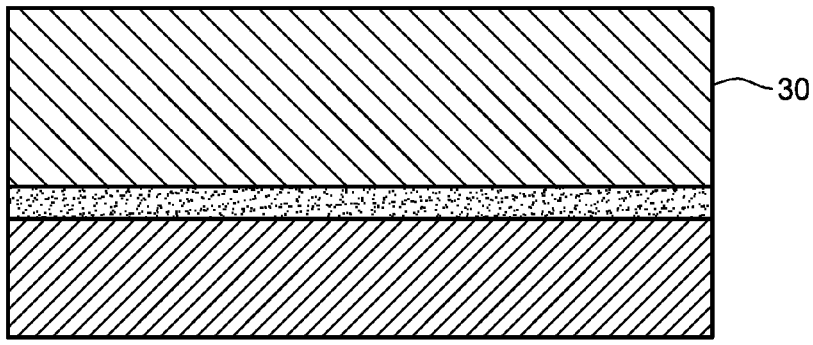
Figure 1C:
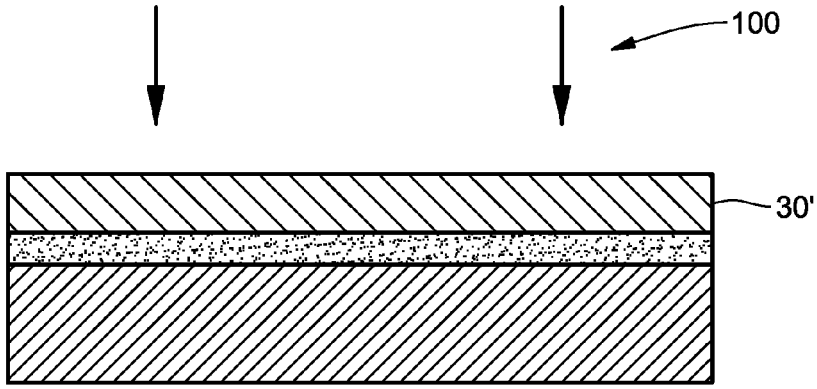
Figure 1D:
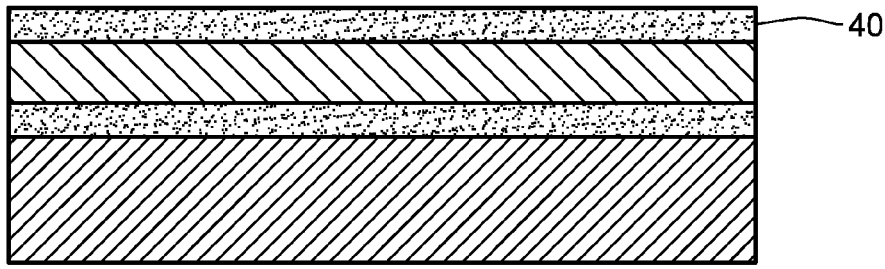
Figure 1E:
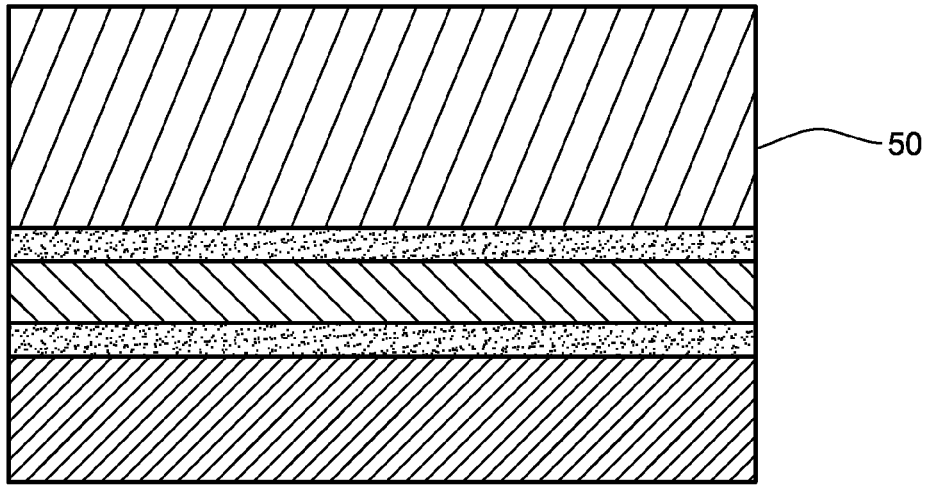
Figure 1F:
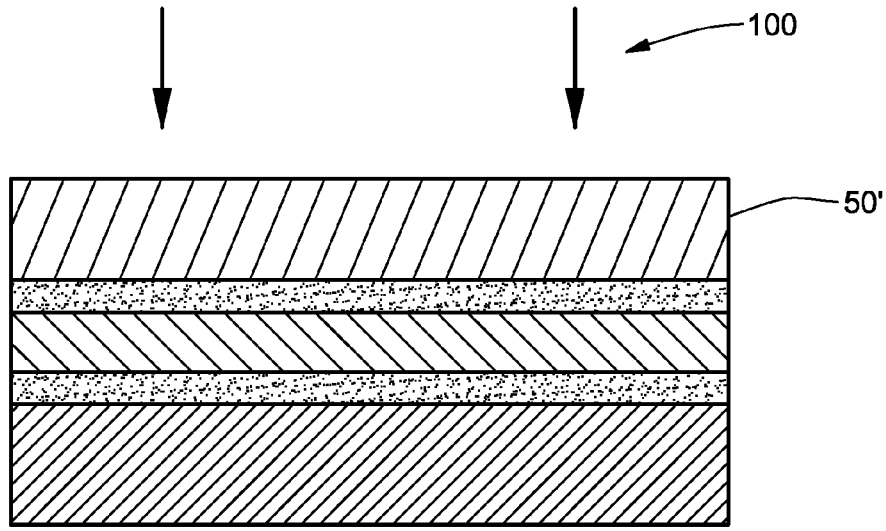
Figure 1G:
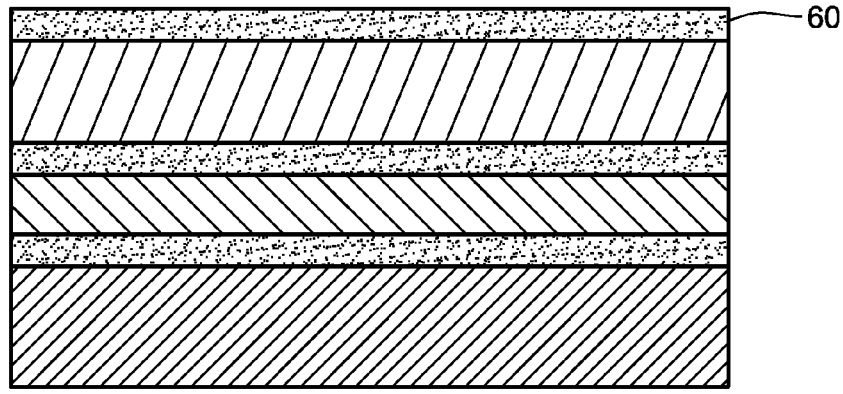
Figure 1H:
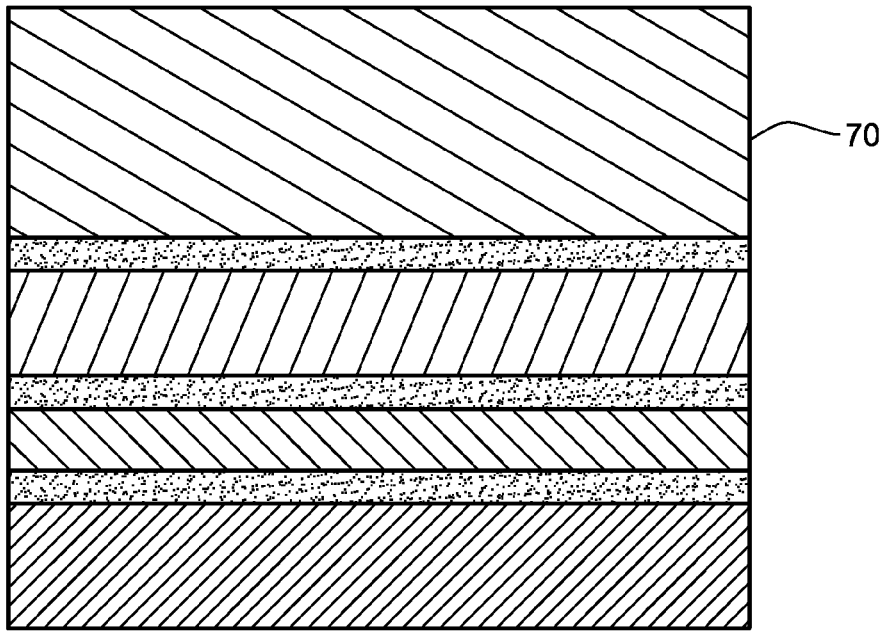
Figure 1I:
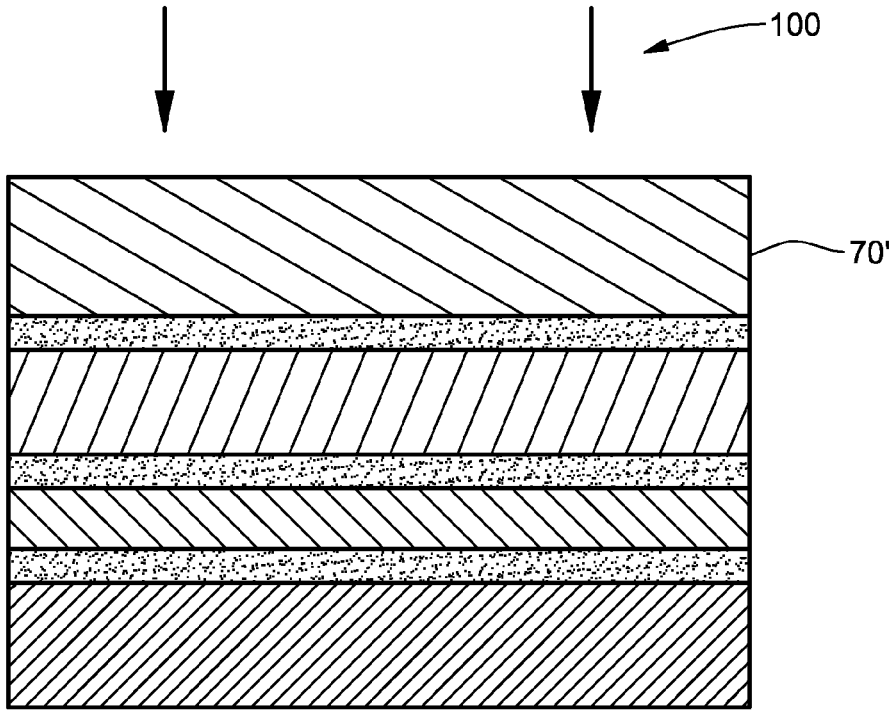

An x-ray optic structure and exemplary technique for its formation are disclosed with reference to FIGS. 1*a-i*. (The dimensions in these drawings are exaggerated, and not necessarily in proportion, for illustrative purposes only.) As discussed further below, the optic formed according to the present invention includes multiple layers of, e.g., silicon, each layer having a different, pre-determined crystalline orientation, and bonded together using, e.g., a silicon-on-insulator bonding technique.

Silicon-on-insulator (SOI) bonding techniques are known in the art, as described in Celler et al, "Frontiers of Silicon-on-Insulator," Journal of Applied Physics, Volume 93, Number 9, 1 May 2003, the entirety of which is incorporated by reference. In general, SOI techniques involve molecular bonding at the atomic/molecular level using, e.g., Van der Walls forces, and possibly chemically assisted bonding. The term "material-on-insulator" is used broadly herein to connote this family of techniques, without limiting the material to silicon. The present invention leverages the maturity of the SOI process to fabricate, in one embodiment, a curved monochromating x-ray optic having multiple layers, each with a potentially different crystal orientation.

A first substrate 10 (e.g., silicon or germanium) is provided having a first crystalline orientation (represented by the direction of the hash pattern). An oxide layer 20 is formed over the substrate 10 using known processes such as thermal growth (see Celler). A second layer 30 (e.g., silicon), having a second crystalline orientation, is bonded to layer 10 using the above-described SOI bonding techniques. The second layer is then polished 100 (using a standard planar polishing process, e.g., chem-mech polishing), leaving layer 30'. In one embodiment the resultant layer thicknesses are 1-5 um for the silicon layers, and about 0.1-0.5 um for the intervening oxide layers.

This process is repeated using another oxide layer 40, and another layer 50 (again, having its own customized orientation). Layer 50 is then polished 100 leaving layer 50'.

This process can be repeated again, using another oxide layer 60, and another layer 70 (again, having its own customized orientation). Layer 70 is then polished 100 leaving layer 70'.

Figure 2:
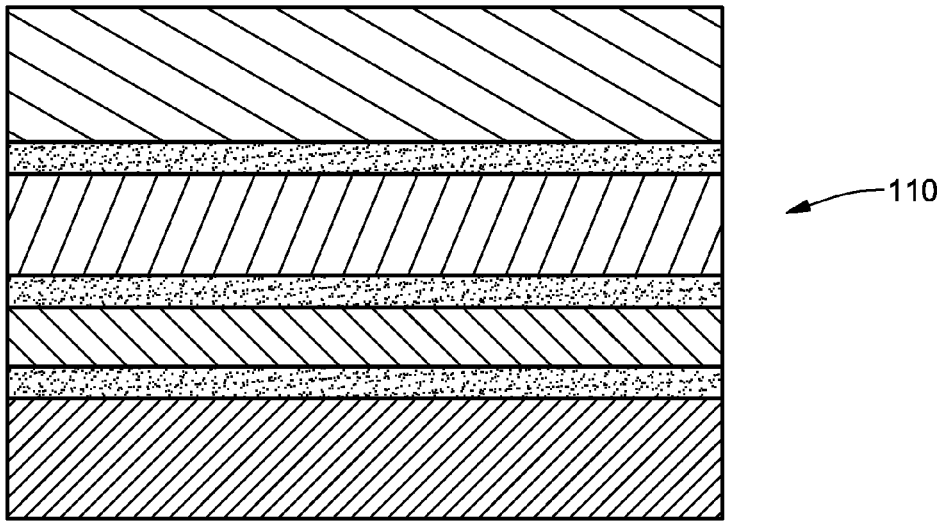
FIG. 2 depicts a finished, 4-layer optic structure, in accordance with an aspect of the present invention.

FIG. 2 shows the resulting thin (about 20-50 um), layered structure 110 having four finished layers, each with its own, predetermined crystalline orientation. Though four layers are shown in this example, the present invention can encompass any plurality of layers, depending on design parameters. And, not all the orientations need to be different. By pre-determining the crystalline orientation of each layer, the diffraction properties of the structure as a whole can be optimized.

According to the present invention, each individual crystalline layer provides an individual diffractive effect. These diffractive effects can be separately modeled, and their collective effect in the final optic can then be predicted and implemented according to final design criteria. This stands in contrast to known "multi-layer" optics, having many layers of angstrom/nanometer thicknesses, each without an individual diffractive effect, but wherein the interactions between the layers result in an overall diffractive effect.

In another aspect of the present invention, layers of differing material composition can be employed in the same optic, with either the same or differing crystalline orientations between the layers (or mixes thereof); and layers of similar (or the same) material composition can be employed, again with either the same or differing crystalline orientations between the layers (or mixes thereof). In any of these aspects of the present invention, especially where the above-described methods of material-on-insulator may be unsuitable, adhesive (e.g., epoxy) layers can be used to bind adjacent crystalline layers in accordance with the sequence of steps discussed above for the material-on-insulator bonding technique.

Figure 3:
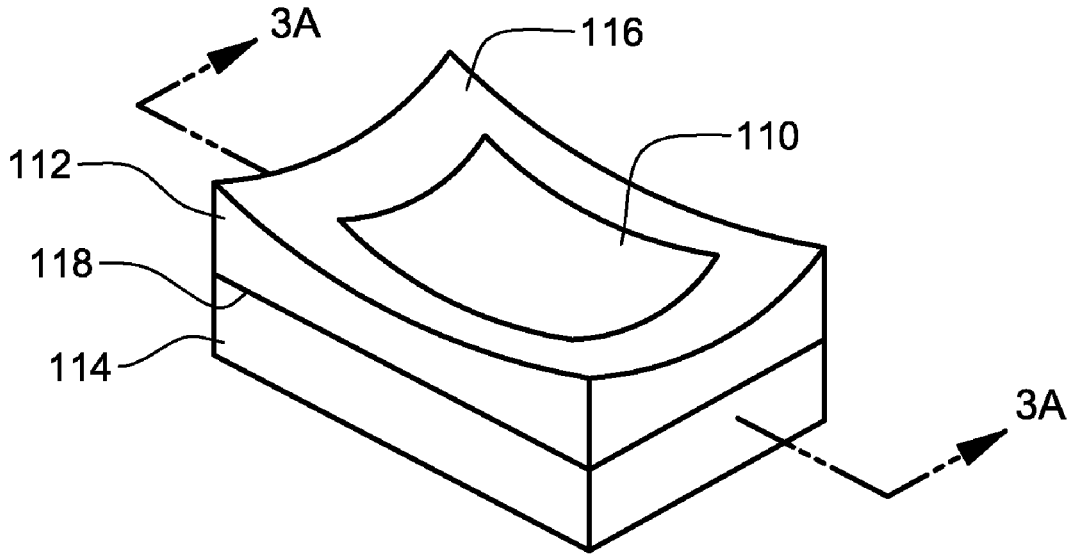
FIG. 3 depicts one embodiment of a point-focusing, doubly curved monochromating optic using the above-described layered structure.
Figure 3A:
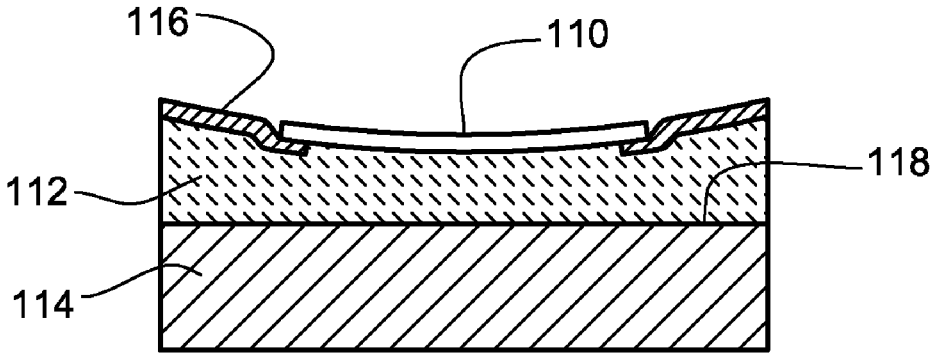
FIG. 3A is a cross-sectional, elevational view of the optic of FIG. 3, taken along line A-A.

Structure 110 can then be formed into a curved, monochromating optic, including a doubly-curved crystal (DCC) optic. One embodiment of such a doubly-curved optical device is depicted in FIGS. 3 and 3A, and is described in detail in U.S. Pat. No. 6,285,506 B1, issued Sep. 4, 2001, the entirety of which is hereby incorporated herein by reference.

In the embodiment of FIG. 3, a doubly-curved optical device includes the flexible layer 110, a thick epoxy layer 112 and a backing plate 114. The structure of the device is shown further in the cross-sectional elevational view in FIG. 3A.

In this device, the epoxy layer 112 holds and constrains the flexible layer 110 to a selected geometry having a curvature. Preferably, the thickness of the epoxy layer is greater than 20 μm and the thickness of the flexible layer is greater than 5 μm. Further, the thickness of the epoxy layer is typically thicker than the thickness of the flexible layer. The flexible layer can be one of a large variety of materials, including: mica, Si, Ge, quartz, plastic, glass etc. The epoxy layer 112 can be a paste type with viscosity in the order of $10^3$ to $10^4$ poise and 30 to 60 minutes pot life. The backing plate 114 can be a solid object that bonds well with the epoxy. The surface 118 of the backing plate can be flat (FIG. 3A) or curved, and its exact shape and surface finish are not critical to the shape and surface finish of the flexible layer. In the device of FIGS. 3 & 3A, a specially prepared backing plate is not required.

Surrounding the flexible layer may be a thin sheet of protection material 116, such as a thin plastic, which is used around the flexible layer edge (see FIG. 3A). The protection material protects the fabrication mold so that the mold is reusable, and would not be necessary for a mold that is the exact size or smaller than the flexible layer, or for a sacrificial mold.

Figure 4:
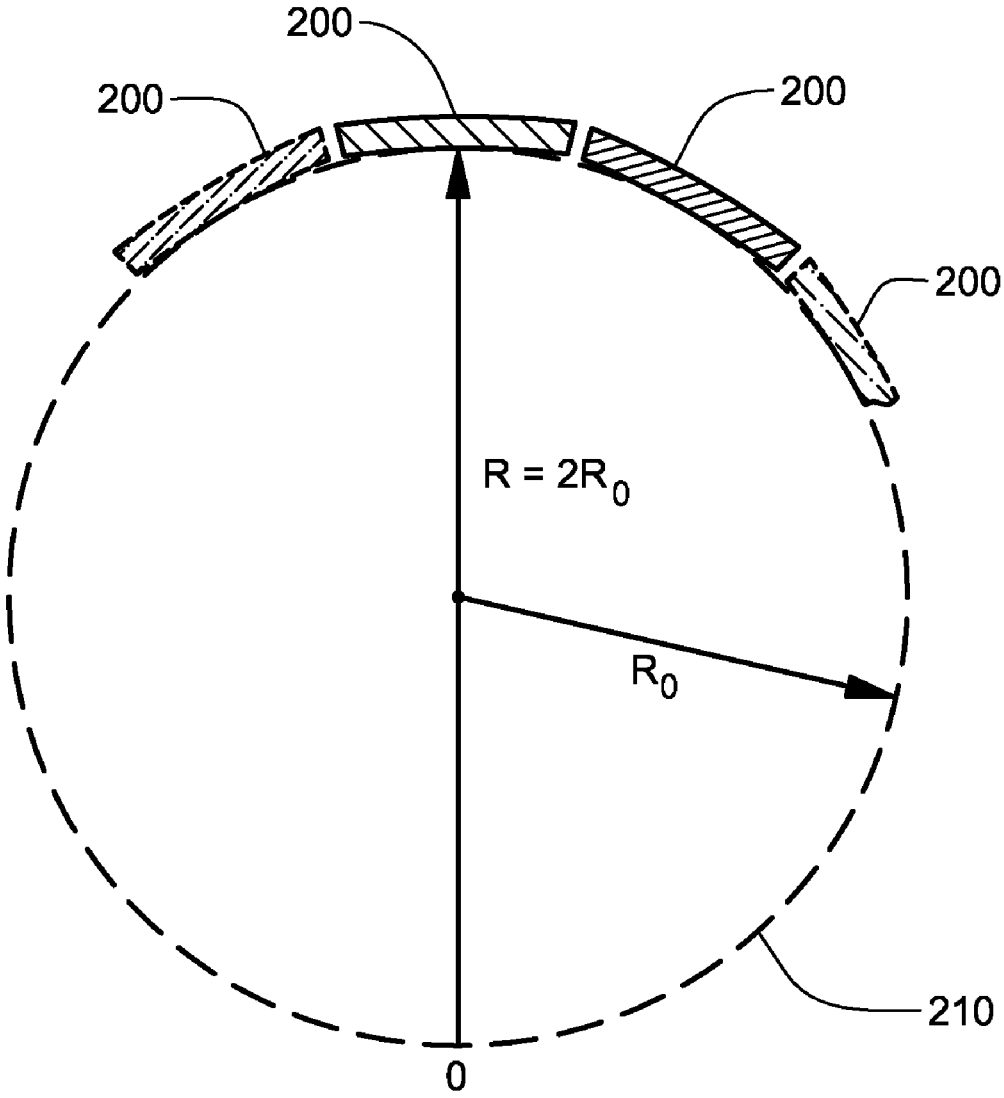
FIG. 4 depicts another possible embodiment of a focusing, curved monochromating optic (and illustrating Rowland circle geometry) using multiple instances (similar or different) of the above-described layered structure.

Doubly-curved optical devices, such as doubly-curved crystal (DCC) optics, are now used in material analysis to collect and focus x-rays from a large solid angle and increase the usable flux from an x-ray source. Three-dimensional focusing of characteristic x-rays can be achieved by diffraction from a toroidal crystal used with a small x-ray source. This point-to-point Johan geometry is illustrated in FIG. 4. The diffracting planes of each crystal optic element 200 can be parallel to the crystal surface. If the focal circle 210 containing a point source and the focal point has radius $R_0$, then the crystal surface has, for example, a radius R of curvature of $2R_0$ in the plane of the focal circle and a radius of curvature of $r=2R_0 \sin^2\theta_{Brag}$ in the perpendicular plane, with the radius centered on a line segment drawn between the source and the focal point. X-rays diverging from the source, and incident on the crystal surface at angles within the rocking curve of the crystal will be reflected efficiently to the focal or image point. The monochromatic flux density at the focal point for a DCC-based system is several orders of magnitude greater than that of conventional systems with higher power sources and similar source to object distances. This increase yields a very high sensitivity for use in many different applications, including (as described herein) x-ray fluorescence and diffraction.

As a further enhancement, FIG. 4 illustrates that the optical device may comprise multiple doubly-curved crystal optic elements 200 arranged in a grid pattern about the Rowland circle, each element formed from a flexible structure 110 as discussed above (either with similar or different element-to-element layer structures). Such a structure may be arranged to optimize the capture and redirection of divergent radiation via Bragg diffraction. In one aspect, a plurality of optic crystals having varying atomic diffraction plane orientations can be used to capture and focus divergent x-rays towards a focal point. In another aspect, a two or three dimensional matrix of crystals can be positioned relative to an x-ray source to capture and focus divergent x-rays in three dimensions. Further details of such a structure are presented in the above-incorporated U.S. Pat. No. 7,035,374 B1, issued Apr. 25, 2006.

The layered optic structure of the present invention offers the following advantages:

- The optic's mosaicity and rocking curves are controlled by layer orientation design.
- The efficiency of the optic is increased—each layer (with its own custom orientation) can have its own field of view, resulting in a composite field of view which increases efficiency and allows the optic to accommodate a larger source spot size. And, by accommodating a larger source spot size, system implementation is easier.

The bandwidth (i.e., monochromatization) of the optic can be controlled, and, advantageously, increased in certain monochromating applications.

The process steps depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A curved, monochromating diffractive optic for accepting and redirecting x-rays, comprising:

at least two planar crystalline layers including a single continuous planar upper layer for accepting the x-rays, the layers each having an individual diffractive effect according to a similar material composition and differing crystalline orientation thereof.

2. The optic of claim 1, wherein the layers are bonded together using a material-on-insulator bonding technique.

3. The optic of claim 2, wherein the layers are silicon, and bonded together using a silicon-on-insulator bonding technique.

4. The optic of claim 3, wherein the optic is a doubly curved, point focusing, monochromating optic, and wherein each layer exhibits an x-ray diffractive property according to its crystalline orientation.

5. The optic of claim 1, wherein the layers are bonded together using an adhesive technique.

6. The optic of claim 1, wherein the optic is a doubly curved, point focusing, monochromating optic.

7. The optic of claim 1, wherein each layer exhibits an x-ray diffractive property according to its crystalline orientation.

8. A curved, monochromating diffractive optic for accepting and redirecting x-rays, comprising:

at least two planar crystalline layers including a single continuous planar upper layer for accepting the x-rays, the layers each having an individual diffractive effect according to a different material composition and differing crystalline orientation thereof.

9. The optic of claim 8, wherein the layers are bonded together using a material-on-insulator bonding technique.

10. The optic of claim 9, wherein at least one of the layers is silicon, and bonded within the optic using a silicon-on-insulator bonding technique.

11. The optic of claim 10, wherein the optic is a doubly curved, point focusing, monochromating optic, and wherein each layer exhibits an x-ray diffractive property according to its crystalline orientation.

12. The optic of claim 8, wherein the layers are bonded together using an adhesive technique.

13. The optic of claim 8, wherein the optic is a doubly curved, point focusing, monochromating optic.

14. The optic of claim 8, wherein each layer exhibits an x-ray diffractive property according to its crystalline orientation.

15. A curved, monochromating diffractive optic for accepting and redirecting x-rays, comprising:

at least two planar, crystalline layers including a single continuous planar upper layer for accenting the x-rays, the layers each having an individual diffractive effect according to different material compositions and having similar or differing crystalline orientations thereof.

16. The optic of claim 15, wherein the layers are bonded together using a material-on-insulator bonding technique.

17. The optic of claim 16, wherein the optic is a doubly curved, point focusing, monochromating optic, and wherein each layer exhibits an x-ray diffractive property according to its crystalline orientation.

18. The optic of claim 15, wherein the layers are bonded together using an adhesive technique.

19. The optic of claim 15, wherein the optic is a doubly curved, point focusing, monochromating optic.

20. The optic of claim 15, wherein each layer exhibits an x-ray diffractive property according to its crystalline orientation.

21. A method of forming a curved, monochromating diffractive optic for accepting and redirecting x-rays, comprising:

using a material-on-insulator bonding technique to bond at least two planar material layers together, including a single continuous planar upper layer for accepting the x-rays, each of the at least two layers having an individual diffractive effect according to a pre-determined crystalline orientation, and similar or different material composition; and forming the at least two bonded layers into the curved, monochromating diffractive optic.

22. The method of claim 21, further comprising forming the at least two bonded layers into the curved optic using a mold.

23. The method of claim 21, wherein the curved optic is a doubly curved, point focusing, monochromating optic.

24. A method of forming a curved, monochromating diffractive optic for accepting and redirecting x-rays, comprising:

using an adhesive bonding technique to bond at least two planar material layers together, including a single continuous planar upper layer for accepting the x-rays, each of the at least two layers having an individual diffractive effect according to a pre-determined crystalline orientation, and similar or different material composition; and forming the at least two bonded layers into the curved, monochromating diffractive optic.

25. The method of claim 24, further comprising forming the at least two bonded layers into the curved optic using a mold.

26. The method of claim 24, wherein the curved optic is a doubly curved, point focusing, monochromating optic.

* * * * *